US006973891B1

(12) United States Patent
Warner

(10) Patent No.: US 6,973,891 B1
(45) Date of Patent: Dec. 13, 2005

(54) DUAL SEAL SELF-CLOSING BOAT DRAIN PLUG APPARATUS

(76) Inventor: Jerald R. Warner, 787 Boulevard of the Champions, Shalimar, FL (US) 32579

( * ) Notice: Subject to any disclaimer, the term of this patent is extended or adjusted under 35 U.S.C. 154(b) by 0 days.

(21) Appl. No.: 11/021,307

(22) Filed: Dec. 23, 2004

(51) Int. Cl.[7] ..... B63B 13/00
(52) U.S. Cl. ..... 114/197
(58) Field of Search ..... 114/183 R, 197; 251/144; 137/614.17, 614.2

(56) References Cited

U.S. PATENT DOCUMENTS 3,879,013 A * 4/1975 Hajek, Jr. ..... 251/144
4,690,169 A * 9/1987 Jobe ..... 137/614.16
5,551,479 A * 9/1996 Graves ..... 137/614.2
6,338,309 B1 * 1/2002 Michelson ..... 114/183 R
6,634,312 B2 * 10/2003 Warner et al. ..... 114/197

* cited by examiner

*Primary Examiner*—Stephen Avila
(74) *Attorney, Agent, or Firm*—J. Ronald Richebourg

(57) ABSTRACT

The present invention is a drain plug assembly designed and configured to remain in the drain hole of a conventional pleasure boat, regardless of whether the vessel is in or out of the water. This drain plug assembly includes a body assembly having a single chamber. The chamber houses a shut-off valve for enabling the boater to open or close the drain plug assembly. This will allow water to escape or prevent it from entering the boat, respectively. A safety assembly is included in the chamber. The safety assembly prevents water passage into the boat should the user forget to close the drain plug assembly, prior to placing the boat in water.

20 Claims, 5 Drawing Sheets

DUAL SEAL SELF-CLOSING BOAT DRAIN PLUG APPARATUS

BACKGROUND OF THE INVENTION

1. Field of the Invention

The present invention relates generally to a drain plug apparatus for use with boats, and more specifically to a dual seal drain plug assembly including a self-closing shutoff valve that is designed and configured to enable water to exit when the boat is out of the water and will prevent water from entering the boat after launch.

2. Description of the Prior Art

Most boats include a drain plug that is located on the lower portion of the transom. The purpose for this plug is to enable water to escape from the boat's bilge. Thus, when the boat is removed from the water, the user can remove the plug and allow all standing water to be removed. Generally, boats are removed from the water after each use and stored on a trailer, boatlift, rack in a marina, or the like. As is customary, the plug is left out of the boat to keep the bilge dry while in storage.

The most popular drain plug utilized today is a threaded plug that screws into a hole that is located at the lower end of a boat's transom. The vast majority of boat manufacturers use a ½ inch externally threaded brass plug which screws into a matching brass female fitting that is affixed to the existing drain hole. A few boat manufacturers incorporate plugs with non-standard threads, or use plugs of other diameters or materials. Others will incorporate the exterior of the plug with non-threaded rubber material. Such plugs fabricated from non-treaded rubber are known as a stopper.

In all cases where a plug or stopper is employed, operator intervention is required to dislodge and reinstall the particular device. Though efficient, this conventional form does cause plugs to often be misplaced, lost, or even stolen. Another problem associated with the conventional plug is that there is a chance for the plug to be "cross-threaded" when reinstalled. This "cross-threading" can cause leakage. The most serious problem with conventional drain plugs is that the operator sometimes forgets to install them prior to launching the boat. When this occurs, the boat will rapidly fill with water resulting in significant damage, potentially sinking the boat, and inherently placing the passenger's safety in jeopardy.

As such, devices have been developed that will reduce the requirement for operator intervention. For example, U.S. Pat. No. 4,019,454 discloses a ball assembly that will swing to seal the existing hole when the boat is not in movement. U.S. Pat. No. 4,198,918 discloses a plug that includes a spring-biased plunger that will be released (in a closed state) by the action of a float mechanism when the boat is lowered in the water. U.S. Pat. No. 5,385,108 discloses a plug that is hingedly secured to a cap and will swing shut to seal the device when submerged.

Many other devices exist on the market that utilize a ball check valve that is either mounted inside or outside the transom drain hole. Still other devices currently marketed use flexible rubber flaps that are shaped to allow water to flow out of the drain but will seal when water attempts to flow in the reverse direction. Though somewhat successful, each method does have a single failure point in the sealing mechanism. The seals can fail if contaminated by common bilge trash (weed, sand, leaves, bugs, or the like). Still other devices have been developed to provide a warning when the plug is removed, for example see U.S. Pat. No. 4,542,373 and U.S. Pat. No. 4,843,376. Though efficient, these devices tend to be costly; difficult to install, and depend on battery power and proper wiring, which are both subject to failure.

Though bilge pumps are installed on most water vessels larger than 16 feet in length to automatically remove excess water from the boat's bilge, these pumps will only activate when the water level in the boat reaches a pre-set level. These particular pumps are designed to effectively remove water that enters the boat due to rain, slow leaks, wave action, or the like. The pumps unfortunately cannot keep up with constant, high-volume in-flow water, such as what occurs when the plug is not replaced in the drain hole of a boat. In addition, these pumps can burn out if they remain operating for an extended period of time, thereby defeating its purpose. Further the pumps are inactive when there is a power failure.

In my earlier Patent, U.S. Pat. No. 6,634,312, I describe a one-way self closing drain plug assembly having two or three chambers wherein one contains a self-closing shutoff valve and the other chamber(s) contain a check valve(s). This invention achieves the intended purpose to efficiently and adequately enable water to be removed when desired by a boat operator and automatic closure to prevent water from entering the vessel when the boat is moving in the water. However, its multi-chamber design is expensive to manufacture, its single-seal shut-off valve seal has a single point of failure, its strainer filter design is difficult to install, and the shut-off valve locking mechanism is not intuitive to operate.

Accordingly, it is seen that there is a need to provide a drain plug assembly that will efficiently and adequately enable water to be removed when desired by a boat operator and one that will automatically close so as to prevent water from entering the vessel when the boat is in water. Moreover, the assembly should provide for low cost construction, improved reliability, ease of installation, and intuitive operation.

As will be seen, the present invention achieves its intended purposes, objectives and advantages by accomplishing the needs as identified above, through a new, useful and unobvious combination of component elements, which is simple to use, with the utilization of a minimum number of functioning parts, at a reasonable cost to manufacture, assemble, and test and by employing only readily available material.

SUMMARY OF THE INVENTION

As will be amplified in greater detail hereinbelow, the present invention solves one of the prior art problems by providing a drain plug assembly designed and configured to remain in the drain hole of a typical pleasure boat, regardless of whether the vessel is in or out of the water. The drain plug assembly of the present invention will further enable the boater to open or close the drain plug assembly for allowing the water to escape or prevent entrance into the boat, respectively. A safety assembly is included for prevention of water passage into the water vessel should the user forget to close the drain plug assembly prior to placing the boat in water.

In order to provide for such a configuration, the present invention comprises body assembly having an inlet end, an outlet end and a central chamber sandwiched therebetween. The inlet end is secured to the existing drain hole of the boat. To enable attachment, the exterior of the inlet end includes attaching features that correspond to the existing hole. Thereby providing for the exterior to be threaded and fabricated from rubber or the like.

A hollow channel extends through the interior of the valve assembly 10 from the inlet end, the central chamber and the outlet end thereof. Hence, a path for water is provided to travel through the channel from the inlet end, through the central chamber and exit out the outlet end. Located in the central chamber is the valve assembly itself. This valve assembly, known as the shut-off valve is controlled via a lever located exteriorly therefrom. The user can open (fluid flow permitted) or close (fluid flow prohibited) the assembly via this lever. To prevent water from entering the assembly from the outlet when the device is in the water, the central chamber also houses a check valve assembly. Further, to increase reliability of the invention, the shut-off valve is structured to interact with the check valve in such a manner to close the check valve when the shut-off valve is also in the closed position, thereby providing a secondary seal.

To enhance the present invention, the handle of the shut-off valve is structured such that when the unit is left in an open position and the boat is placed in the water in an operational mode, the boat starts to move and this movement in combination with the flow of the water applies pressure to the outer surface of the handle. This pressure forces the handle to move, which innately causes the valve to close.

The handle also includes a flexible member with a protrusion that extends into a matching detention in the valve body when the valve is in the closed position, thereby locking the valve closed. The flexible member also includes a release tab positioned in such a manner so that the operator can simultaneously depress the release tab with their thumb and rotate the valve to the open position using the same hand.

Other features that may be added to the present invention include a filter affixed to the inlet end. This filter will prevent debris from entering into the drain plug assembly of the present invention. Further, to increase the life span of the present invention, any one or all of the components can be fabricated from or coated with an anti-rusting material.

Accordingly, it is an object of the present invention to provide a drain plug apparatus that will overcome the deficiencies, shortcomings, and drawbacks of prior drain plugs and methods thereof.

Another object of the present invention is to provide a drain plug apparatus that can successfully and efficiently accommodate any type or style of water vessel having a drain hole located therein.

Still a further object of the present invention is to provide for a drain plug apparatus that will successfully enable water to flow therefrom when desired and will prevent water from entering even when the boat is in the water and the shut-off valve is in an opened position.

Yet a further object of the present invention, to be specifically enumerated herein, is to provide a drain plug apparatus in accordance with the preceding objects and which will conform to conventional forms of manufacture, be of simple construction and easy to use so as to provide a drain plug apparatus that would be economically feasible, long lasting and relatively trouble free during utilization.

Although there have been many inventions related to drain plugs, none of the inventions have become sufficiently compact, low cost, or reliable enough for repeated use. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
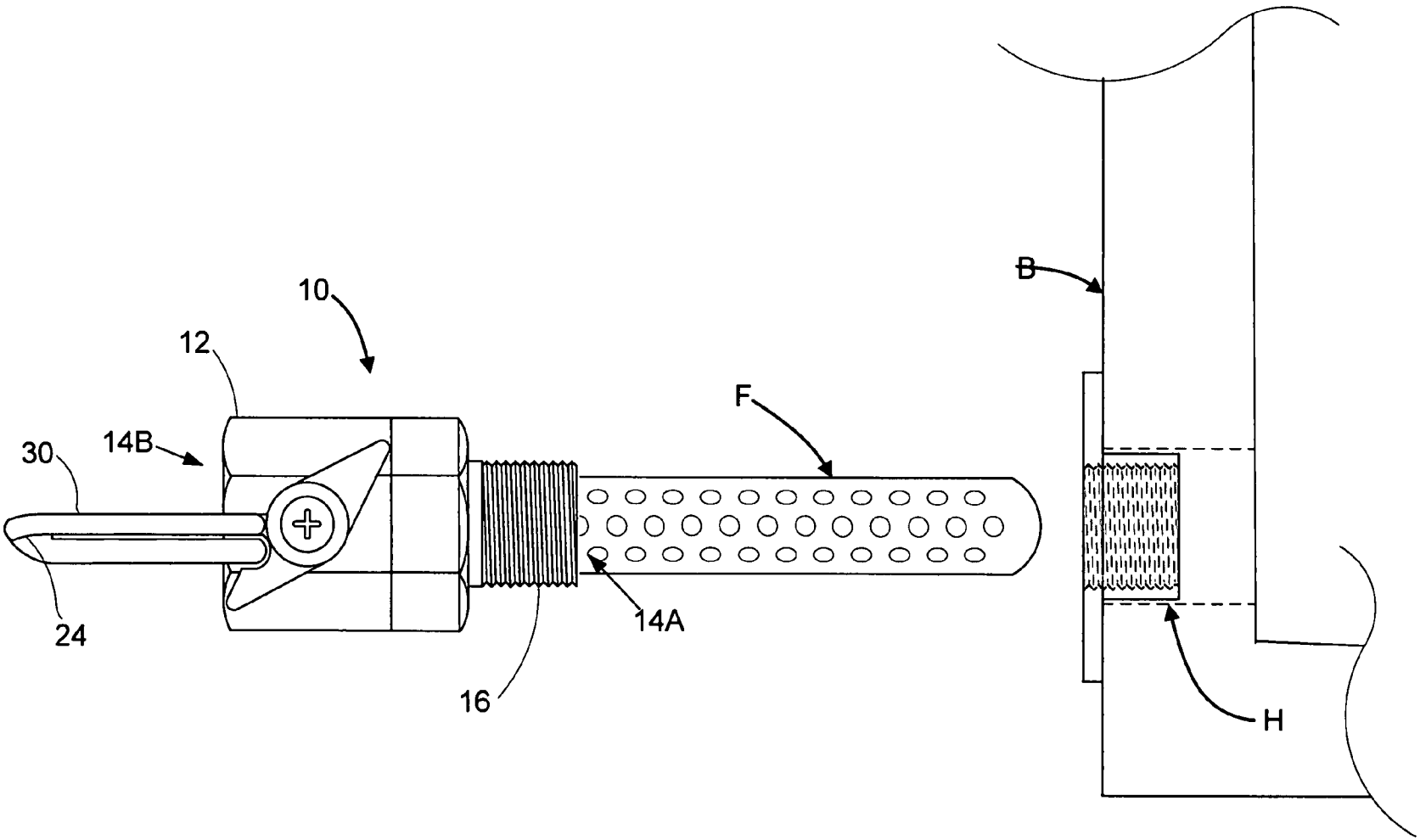
FIG. 1 is a side view of the drain plug apparatus of the illustrated embodiment with an existing drain hole of a typical boat.

With reference to the drawings, the present invention comprises a drain plug apparatus 10, which will be described in greater detail hereinbelow. As shown, the drain plug apparatus 10 is designed and configured to be attached to the existing drain hole of a boat B. The attachment occurs exteriorly, as shown in FIG. 1. The drain plug apparatus 10 of the present invention is structured so that it will remain in the drain hole of the boat B, regardless of whether the boat is in or out of the water. In use, the present invention will enable the boater to open or close the drain plug apparatus for allowing the water to escape or prevent entrance to the boat, respectively. A safety device is included for preventing water from flowing into the boat should the user forget to close the drain plug apparatus prior to placing the boat in the water.

In order to provide for such a configuration, the apparatus 10 of the present invention, as seen in FIG. 1, includes a body assembly 12 having outer ends 14A and 14B. The outer ends are open to provide for the ends to act as inlet and outlet ends. As seen in FIG. 1, end 14A acts as the inlet end and end 14B acts as the outlet end.

As illustrated in FIG. 1, the exterior of the first end 14A includes an attaching element 16, known as the transom connector, that enables this end to be attached to the existing drain hole H of a conventional boat B. Accordingly, the attaching element 16 is provided that corresponds to the existing hole located within the boat. As shown, the attaching element 16 includes external threads that are designed to be attached to the drain hole having mating internal threads. Optionally, the external end can be fabricated from rubber, plastic, or the like to provide for the device to be frictionally held so as to provide for a device that can be secured to a drain hole that does not include internal threads.

The body 12 is hollow and includes a single chamber. This illustration is shown in FIGS. 2A~2F. The chamber 18 includes open ends, as shown. The inlet end 14A and outlet end 14B of the chamber include valve seats 20. This will provide for the open ends to be smaller in diameter than the diameter of the actual chamber.

As seen, the shutoff valve assembly 40 is shown having a blockage member 42 that is secured via a shaft 44 to a shank 46. The blockage member can include any configuration and it is shown to be a spherical section. Secured to shank 46 is the handle 24. The length of the shaft 44 is sized such that when the shut-off valve is in the closed position, the shaft 44 moves the check valve ball 32 towards the inlet seal 20 and exerts sufficient pressure to seal the check valve. The force of the shaft against the check valve ball and inlet seal is transferred through the shaft to also seal the blockage member 42 against its seat 20, thereby providing a seal on both ends of the valve assembly. This is a key feature of my invention of a dual seal boat plug drain apparatus disclosed herein.

The handle 24 controls the movement of the blockage member 42 and thus will provide for the shutoff mechanism shaft and handle to be either perpendicular to the valve body (open position), as seen in FIGS. 2A, 2B, 2C, 2D, 4A, and 4B or aligned with the valve body to block the open block flow of fluid, as seen in FIGS. 2E, 2F, 4E, and 4F. This manner of opening and closing the lever actuated valve is specifically designed for this application and is the opposite of the motion found on conventional ball valve assemblies. In addition, a catch mechanism is provided on the manually operated handle so as to prevent the handle from opening by propeller wash that is generated when the boat engine is reversed. Thus, in use the user can rotate the blockage member enabling fluid flow to occur through the valve apparatus 10.

The handle 24, as seen in FIGS. 2~4 includes a unique structure. The handle 24 is designed such that should the user place the boat in water when the drain plug apparatus 10 is in an open position and exteriorly located, and operation of the vessel continues, the motion of the water in combination with the motion of the boat will force the handle 24 to rotate and close. This is accomplished by the shape and arrangement of the handle. As illustrated and described herein, the handle 24 includes a paddle-like configuration so as to provide for a front surface that includes a large surface area and further including an outer end 30 that is curved. This curved portion is illustrated in FIG. 1.

The handle 24 will be located substantially perpendicular to the housing when the lever-actuated valve 40 is open. This will provide for the enlarged surface area to be located perpendicular with respect to longitudinal axis of the boat. This positioning will innately provide for water to contact the surface thereof. Motion of water contacting the enlarged surface will provide for the water to apply a force on the handle. The force will cause the handle to rotate. Movement is continued until the enlarged area is substantially parallel to the housing, intrinsically causing the handle to be located parallel to the housing (see FIGS. 1, 2F, 4E and 4F). Consequently forcing the shutoff member of the valve to rotate and be in a closed position. In essence, the motion of the water will cause the handle to close when the boat is in motion.

Preventing water from entering the boat via the drain hole when submerged therein is a concern that the present invention addresses. In order to avoid water entrance when the lever-activated valve 40 is left open, a safety is provided. The safety will prevent water from entering the inlet of the apparatus 10, thereby preventing water from entering the boat. To provide for such a configuration, the chamber 18 includes a check valve. In the chamber 18, a ball 32 is provided. This ball is sized larger than the inlet of the chamber 18. The shaft 44 and the rotating member 46 of the shutoff valve assembly 40 act as a retaining pin to keep the ball on the inlet side of the chamber. This arrangement provides for the ball to remain within the inlet side of the chamber 18 yet move freely about therein.

Figure 2A:
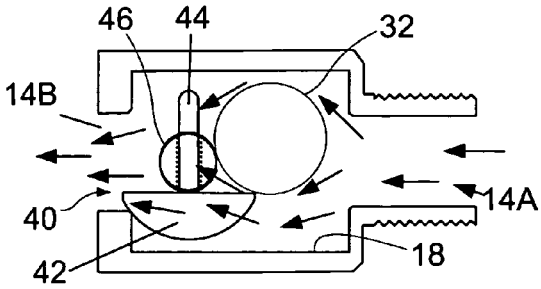
FIG. 2A is a simplified cross-sectional side view of the components used in the drain plug apparatus and illustrating the flow path of water when the drain plug apparatus is in an open position.
Figure 2B:
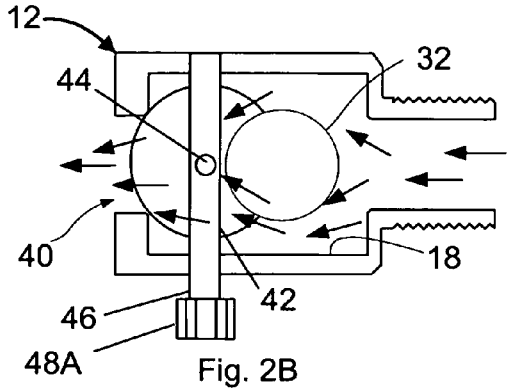
FIG. 2B is a simplified cross-sectional top view of the components used in the drain plug apparatus and illustrating the flow path of water when the drain plug apparatus is in an open position.

Thus, as seen in FIGS. 2A and 2B, when the shutoff valve 40 is in an open position, water from the inside of the boat will flow through the transom connector, and into the chamber 18. The water will push the check valve ball 32 against ball-retaining pin 46 which prevents the ball from blocking the outlet end 14B of the assembly. Water will pass around the ball and retaining pin to provide for the water to exit at the outlet end 14B.

Figure 2C:
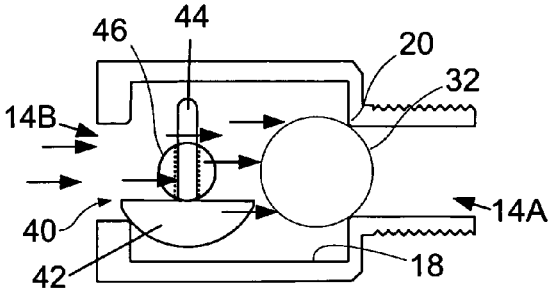
FIG. 2C is a simplified cross-sectional side view of the components used in the drain plug apparatus and illustrating the blockage of fluid flow even though the valve is in an open position.
Figure 2D:
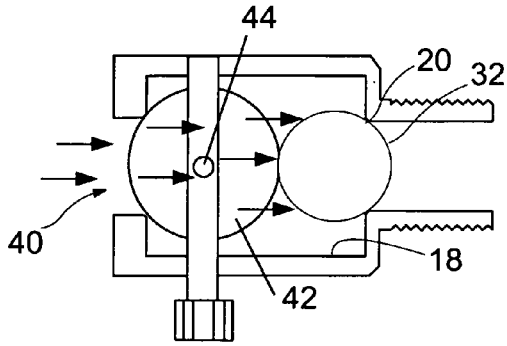
FIG. 2D is a simplified cross-sectional top view of the components used in the drain plug apparatus and illustrating the blockage of fluid flow even though the valve is in an open position.
Figure 2E:
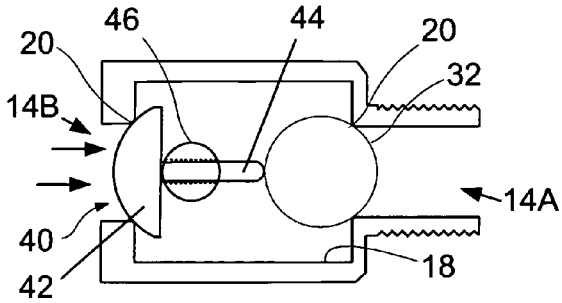
FIG. 2E is a simplified cross-sectional side view of the components used in the drain plug apparatus and illustrating the blockage of fluid flow when the valve is in a closed position.
Figure 2F:
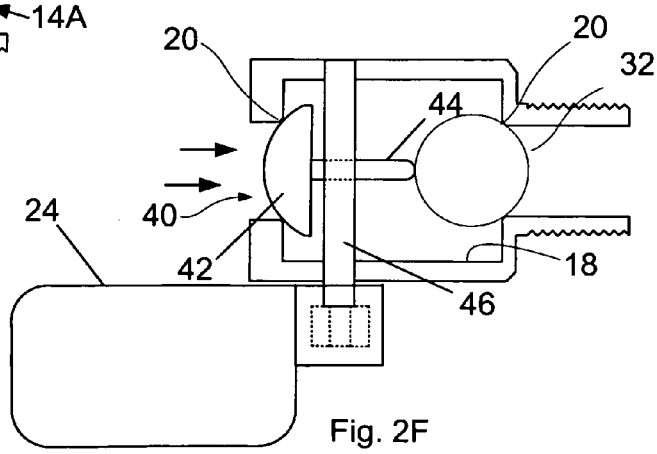
FIG. 2F is a simplified cross-sectional top view of the components used in the drain plug apparatus and illustrating the blockage of fluid flow when the valve is in a closed position.

The check valve will prevent water from entering the boat if the boat is placed in the water while the shut-off lever is in the open position. This is shown in FIGS. 2C and 2D, wherein as the boat is launched water will enter through the outlet end 14B and around the retaining pin 46. The water will force the ball towards the inlet end 14A of the valve chamber and into the seat 20. This will create a seal and prevent the water from passing further into the assembly and thus prevent water from entering the boat.

For enhancing the present invention, a filter F can be utilized for preventing debris or the like from entering into the drain plug appartatus 10 of the present invention. This filter includes an open end and an enclosed end. As seen in FIG. 1, the filter can be attached to the inlet side of the assembly, and thereby be inserted into the boat when the assembly is secured to the drain hole. Preferably, the holes in the filter mesh are sized to allow for small debris to pass through the assembly, but prevent debris large enough to impact valve operation from passing therethrough.

For added safety, the handle can include additional features that will add to the protection of the valve for inherently adding to the protection of the particular vessel. The handle couples to the shut-off valve via a shank 46. The shank 46 is illustrated in FIGS. 2B, 2D, 2F, and 3B. This shank 46 includes a plurality of notches or splines 48A that provide for a star like configuration. The handle will receive the shank and thus it includes an opening having a plurality of splines 48B that are adapted to mate with the splines of the shank as seen in FIG. 3B. Proper mating will guarantee proper placement of the handle to the pin. In addition, this will provide for a handle that is correctly secured so as to efficiently and adequately grip the shank. Once located thereon, a screw or the like is inserted into the hollow seat 50 of the handle and the hollow shaft of the pin for securing it thereto, illustrated in FIGS. 3A, 3B and 3C.

Figure 3A:
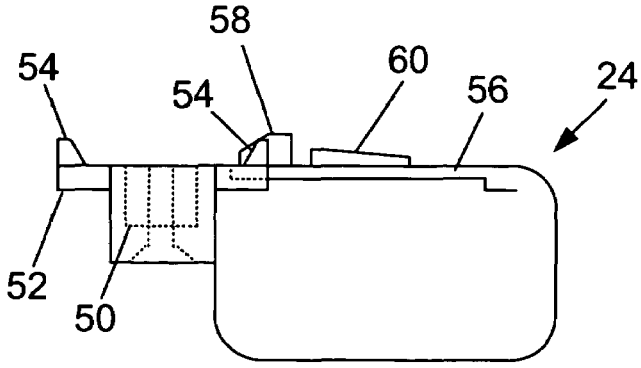
FIG. 3A is a side view of the handle of the shut-off valve apparatus used in the drain plug apparatus of the present invention.
Figure 3B:
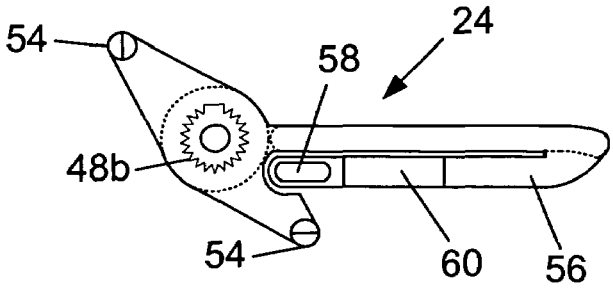
FIG. 3B is a top side view of the handle of the shut-off valve apparatus used in the drain plug apparatus of the present invention.
Figure 3C:
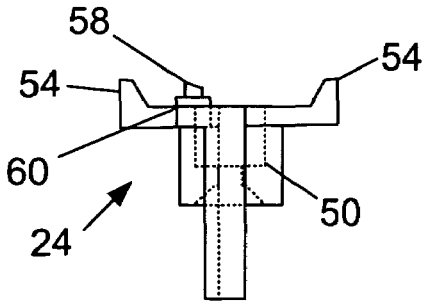
FIG. 3C is a front view of the handle of the shut-off valve assembly used in the drain plug apparatus of the present invention.

Secured to the lower portion of the handle 24 and extending outwardly therefrom are two projections 58, as seen in FIGS. 3A, 3B and 3C. This flange includes a lower surface having a plurality of feet 54. The feet aid in the rotational control of the handle by preventing rotation of the handle beyond the fully open and fully closed position. These feet can be tapered as illustrated.

Extending along the length of the handle is a flexible member 56 having a catch pin 58 and release tab 60 attached thereto. This configuration renders a close-position catch mechanism. The catch mechanism along with an indentation 64 formed in the valve body (as shown in FIG. 4) provide a means to prevent the valve from opening without operator intervention. This feature is important because it prevents propeller wash from opening the valve when the boat moves in reverse.

Figure 4A:
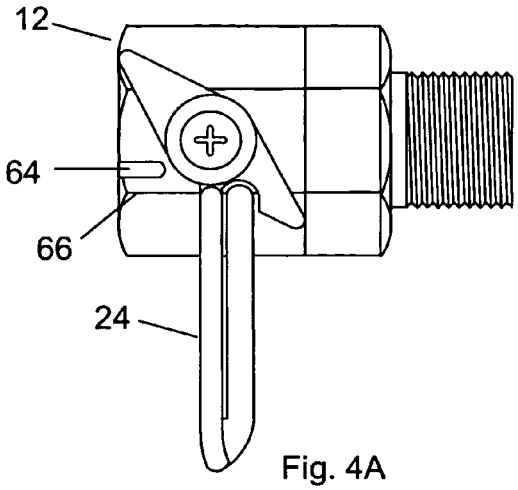
FIG. 4A is a side view of the drain plug apparatus of the present invention in an opened position.
Figure 4B:
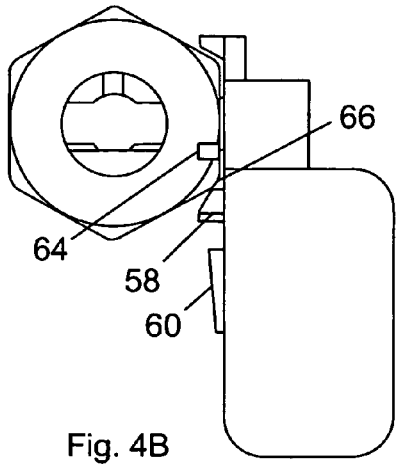
FIG. 4B is a front view of the drain plug apparatus of the present invention, as seen in FIG. 4*a*, in an opened position.
Figure 4C:
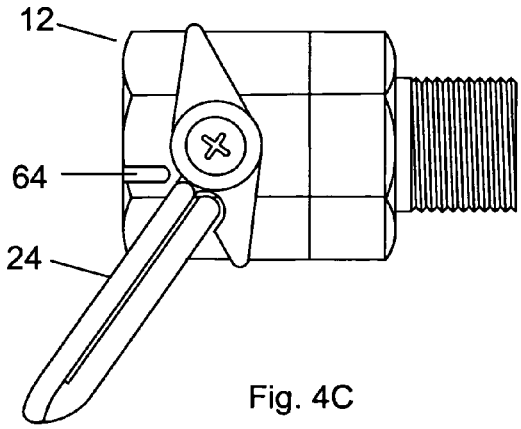
FIG. 4C is a side view of the drain plug apparatus of the present invention being rotated towards the closed position.
Figure 4D:
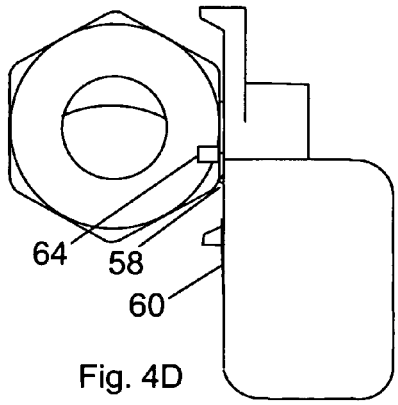
FIG. 4D is a front view of the drain plug apparatus of the present invention, as seen in FIG. 4*c*, being rotated towards a closed position.
Figure 4E:
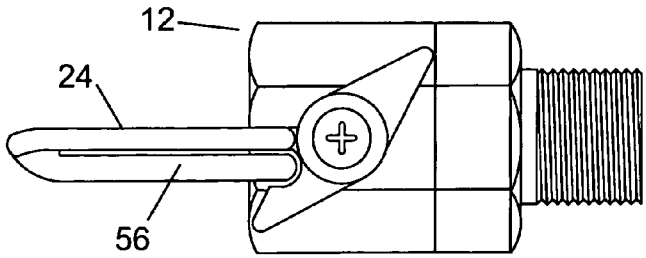
FIG. 4E is a side view of the drain plug apparatus of the present invention in a closed position.
Figure 4F:
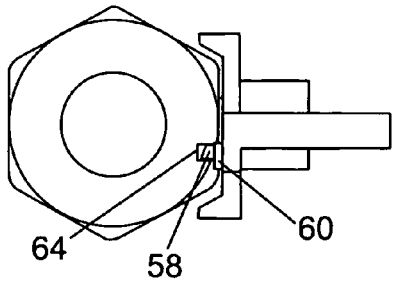
FIG. 4F is a front view of the drain plug apparatus of the present invention, as seen in FIG. 4*e*, in a closed position.

When the valve assembly of the drain plug apparatus 10 is in the fully open position as shown in FIGS. 4A and 4B, the catch pin 58 extends beyond the edge of the valve body 12. As the handle is rotated towards the closed position shown in FIGS. 4C and 4D, the flexible member 56 flexes to allow the catch pin 58 to slide over the corner of the valve body 66. The catch pin 58 is angled to allow smooth movement over the corner 66. When the handle is rotated to the fully closed position, as shown in FIGS. 4E and 4F, the catch pin extends into a matching indentation 64 in the valve body. The shape of the catch pin 58 and indentation 64 prevent opening the valve by simple rotation of the valve handle 24. A release tab 60 is provided with the catch mechanism to provide a means to depress the flexible member 56 and thus extract the catch pin 58 from the indentation 64. The operator can use their thumb to depress the release tab 60 thereby moving the flexible member sufficiently to extract the catch pin 58 from the indentation 64, while simultaneously using the same hand to press downward on the handle 24 to rotate the valve handle from the closed to the open position. The flexible member 56 is positioned so that it is only flexed to extract the catch pin and while the handle is transitioning from closed to open or from open to closed positions. This prevents the flexible member from resting in the flexed position during normal operation, to inherently prevent the catch mechanism from loosing its "springy" nature.

Figure 5:
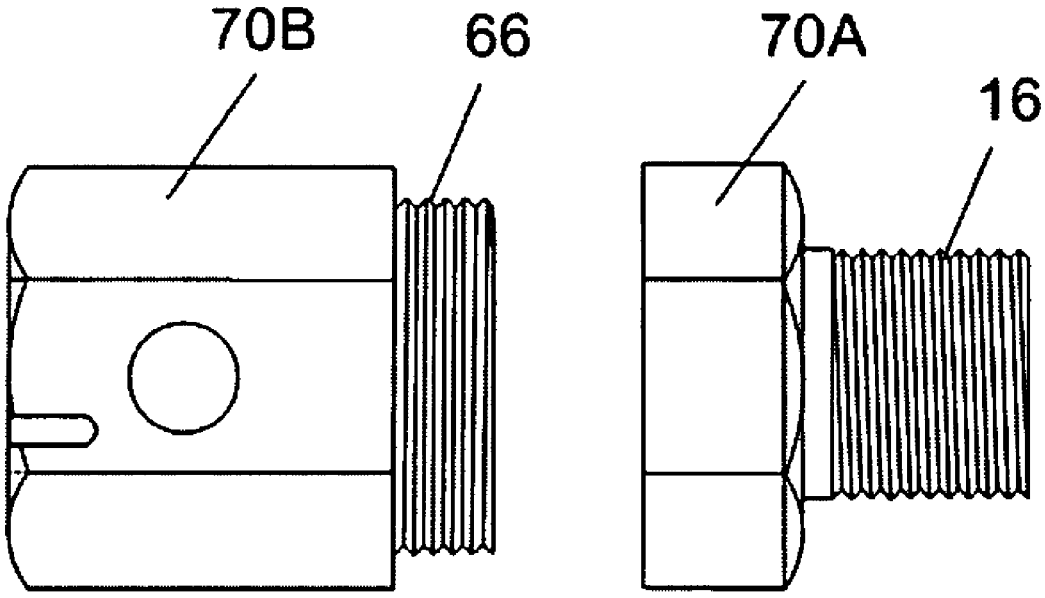
FIG. 5 is a side view of the drain plug body of the present invention in a non-assembled configuration.

The valve assembly 10 may be constructed of removable members 70A and 70B, as seen in FIG. 5. This will provide for each end of the chamber to be a removable member. Optionally, the members of the body assembly can include threads 16 and 66 for enhancing assembly and attaching to the existing aperture of the boat.

Although the invention has been described with reference to a specific embodiment, this description is not meant to be construed in a limiting sense. Various modifications of the disclosed embodiment as well as alternative embodiments of the invention will become apparent to one skilled in the art upon reference to the description of the invention. It is therefore contemplated that the appended claims will cover any such modifications of embodiments that fall within the true scope of the invention.

What is claimed is:

1. A dual seal one-way self-closing drain plug apparatus for a boat comprising:

a hollow body assembly having an inlet end and an outlet end thereof;

a single chamber being located in said hollow body assembly between said inlet end and said outlet end;

said chamber housing a valve assembly including a manual mechanism for opening and closing said valve assembly, wherein said manual mechanism includes a handle coupled to said valve assembly for opening and closing thereof, and said handle is shaped into a paddle that, when in the open position, is disposed perpendicular to the longitudinal axis of said boat, whereby said valve assembly is automatically closed when left open and when exposed to moving fluid caused by movement of said boat;

said chamber also housing a safety device; and said safety device enabling fluid flow to occur in one direction and prevent fluid flow from an opposite direction by blocking access to said first chamber regardless of the position of said valve assembly; and said valve assembly including a shaft interacting with said safety device in such a manner as to move safety device into a closed position when the valve assembly is in the closed position, thereby creating a secondary seal.

2. A drain plug assembly as in claim 1 wherein said chamber includes an attaching device for enabling attachment to a drain hole on said boat.

3. A drain plug assembly as in claim 1 further including a filter secured to said inlet end of said hollow body assembly for preventing debris from passing through said assembly.

4. A drain plug assembly as in claim 1 wherein said paddle includes a front surface having a large surface area and an outer end that is curved so as to scoop said fluid as said boat moves forward.

5. A drain plug assembly as in claim 1 wherein said handle further includes a plurality of legs secured thereto and in contact with said hollow body assembly for providing rotational control of said handle.

6. A drain plug assembly as in claim 1 wherein said handle includes a catch mechanism so as to prevent said handle from opening via propeller wash that is generated when said boat is moving in reverse.

7. A drain plug assembly as in claim 6 wherein said catch mechanism includes a flexible member, extending along the length of said handle and having a catch pin and a release tab secured thereto, an indentation being located on said hollow body, said catch pin when in contact with said indentation prevents further movement of said handle and said release tab enables release of said catch pin from said indentation for manual rotation of said handle.

8. A drain plug assembly as in claim 7 wherein said catch pin is tapered.

9. A dual-seal one-way self-closing drain plug apparatus for a vessel comprising:

a. a hollow body assembly having a single chamber formed therein, said chamber having a single inlet end and a single outlet end thereof;

b. said single chamber housing a valve assembly including a lever for opening and closing said valve assembly, said lever being shaped into a paddle that, when in the open position, is disposed perpendicular to the longitudinal axis of said vessel, whereby said valve assembly is automatically closed when left open and when exposed to moving fluid caused by movement of said vessel;

said chamber also housing a safety device; and said safety device enabling fluid flow to occur in one direction and prevent fluid flow from an opposite direction by blocking access to said first chamber regardless of the position of said valve assembly; and said valve assembly including a shaft interacting with said safety device in such a manner as to move safety device into a closed position when the valve assembly is in the closed position, thereby creating a secondary seal.

10. A drain plug assembly as in claim 9 wherein said chamber includes an attaching device for enabling attachment to a drain hole on said vessel.

11. A drain plug assembly as in claim 9 further including a filter secured to said inlet end of said hollow body assembly for preventing debris from passing through said assembly.

12. A drain plug assembly as in claim 9 wherein said paddle includes a front surface having a large surface area and an outer end that is curved so as to scoop said fluid as said vessel moves forward.

13. A drain plug assembly as in claim 9 wherein said handle further includes a plurality of legs secured thereto and in contact with said hollow body assembly for providing rotational control of said handle.

14. A drain plug assembly as in claim 9 wherein said handle includes a catch mechanism so as to prevent said handle from opening via propeller wash that is generated when said vessel is moving in reverse.

15. A drain plug assembly as in claim 14 wherein said catch mechanism includes a flexible member, extending along the length of said handle and having a catch pin and a release tab secured thereto, an indentation being located on said hollow body, said catch pin when in contact with said indentation prevents further movement of said handle and said release tab enables release of said catch pin from said indentation for manual rotation of said handle.

16. A drain plug assembly as in claim 15 wherein said catch pin is tapered.

17. A dual seal one-way self-closing drain plug apparatus for a boat comprising:

a hollow body assembly having an inlet end and an outlet end thereof and having attaching threads for enabling attachment to a drain hole on said boat;

a single chamber being located in said hollow body assembly between said inlet end and said outlet end;

said chamber housing a valve assembly including a manual mechanism for opening and closing said valve assembly, wherein said manual mechanism includes a handle coupled to said valve assembly for opening and closing thereof, and said handle is shaped into a paddle that, when in the open position, is disposed perpendicular to the longitudinal axis of said boat, said paddle having a large front surface area and an outer end that curved so as to scoop said fluid as said boat moves forward whereby said valve assembly is automatically closed when left open and when exposed to moving fluid caused by movement of said boat;

said chamber also housing a safety device; and said safety device enabling fluid flow to occur in one direction and prevent fluid flow from an opposite direction by blocking access to said first chamber regardless of the position of said valve assembly;

said valve assembly including a shaft interacting with said safety device in such a manner as to move safety device into a closed position when the valve assembly is in the closed position, thereby creating a secondary seal; and, a filter secured to said inlet end of said hollow body assembly for preventing debris from passing through said assembly.

18. A drain plug assembly as in claim 17 wherein said handle includes a catch mechanism so as to prevent said handle from opening via propeller wash that is generated when said boat is moving in reverse.

19. A drain plug assembly as in claim 18 wherein said catch mechanism includes a flexible member, extending along the length of said handle and having a catch pin and a release tab secured thereto, an indentation being located on said hollow body, said catch pin when in contact with said indentation prevents further movement of said handle and said release tab enables release of said catch pin from said indentation for manual rotation of said handle.

20. A drain plug assembly as in claim 19 wherein said catch pin is tapered.

* * * * *